US007047769B2

(12) United States Patent
Stingel

(10) Patent No.: US 7,047,769 B2
(45) Date of Patent: May 23, 2006

(54) LOOP-FORMING SYSTEM AND SINKER FOR SUCH A SYSTEM

(75) Inventor: Uwe Stingel, Messtetten (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/175,312

(22) Filed: Jul. 7, 2005

(65) Prior Publication Data

US 2006/0010926 A1 Jan. 19, 2006

(30) Foreign Application Priority Data

Jul. 14, 2004 (EP) ..... 04016579

(51) Int. Cl.
*D04B 35/06* (2006.01)

(52) U.S. Cl. ..... 66/120

(58) Field of Classification Search ..... 66/116, 66/119, 120, 121
See application file for complete search history.

(56) References Cited

U.S. PATENT DOCUMENTS 1,744,789 A * 1/1930 Miller ..... 66/104
1,877,503 A * 9/1932 Gagne ..... 66/120
3,182,471 A * 5/1965 Fried ..... 66/35
3,978,689 A 9/1976 Vandermeirsch
4,621,506 A 11/1986 Frund et al.
4,637,228 A 1/1987 Shima
6,381,992 B1 5/2002 Haltenhof

FOREIGN PATENT DOCUMENTS

DE 31 43 872 A1 9/1982
GB 12462 A 0/1913

OTHER PUBLICATIONS

Weber, K.P., "Die Wirkerei und Strickerei", MELLIAND, 1981, p. 48, XP 002303287.

* cited by examiner

*Primary Examiner*—Danny Worrell
(74) *Attorney, Agent, or Firm*—Fitch, Even, Tabin & Flannery; Norman N. Kunitz

(57) ABSTRACT

In an improved loop-forming system (1), in particular for compound needles (2), the compound needle during the knitting operation is moved along a nonlinear path. Depending on the embodiment, this path may be a loop, may include a loop, or maybe embodied without a loop. This is achieved by superimposing a transverse motion on the reciprocating needle motion; the transverse motion may be controlled for instance by a pivotably supported sinker, which is disposed in the needle track and defines the pivoting orientation of the compound needle (2).

12 Claims, 6 Drawing Sheets

LOOP-FORMING SYSTEM AND SINKER FOR SUCH A SYSTEM

CROSS REFERENCE TO RELATED APPLICATION

This application claims the priority of European Patent Application No. 04 016 579.7, filed on Jul. 14, 2004, the subject matter of which, in its entirety, is incorporated herein by reference.

1. Field of the Invention

The invention relates to a loop-forming system, to be used for instance as a knitting system, which includes at least one but preferably many compound needles. The invention furthermore relates to at least one sinker for integration into such a knitting system.

2. Background of the Invemtion

In principle, loop-forming systems with compound needles must be distinguished from loop-forming systems with latch needles. Both are used in corresponding knitting machines for producing so-called goods (knitted goods), and each have their own specific advantages and disadvantages. In principle, compound needles have an externally controlled closing element, which serves to open and close the hook. The closing element is actuated by the cam of the knitting system, so that in this respect, completely controlled work can be expected. Latch needles, conversely, use a pivotably supported latch for opening and closing the hook. The latch motion is as a rule not externally controlled, or in other words not controlled directly by the cam of the knitting machine. Instead, as a rule, the motion is due to an interplay of the forces acting on the latch, which originate in the acceleration of the needle, if applicable from brushes provided for needle actuation, and the yarn loops passing over the needle.

Particularly for producing so-called plated knitted goods, latch needles have become established. In plated goods, the knitted goods are made from two yarns, for instance an elastic monofilament yarn and a plating yarn, such as a wool yarn or the like, and these two yarns are knitted jointly. Plating flaws must be avoided. Plating flaws arise for instance if the ground yarn and the plating yarn, which are taken up jointly by the hook of a knitting needle, exchange places or positions in the knitting process. To avoid these plating flaws, the yarns used for plating are delivered separately as long as possible, that is, to just before the hook. In that case, latch needles have the advantage. Closing the hook is done by a pivoting position of the latch, and the yarns (ground yarn and plating yarn) caught in the hook already come into contact as the latch pivots inward and are thus supported and held.

In compound needles, this process is more critical. In them, the compound needle does not support the feeding of the yarn, as is done in a latch needle by the rotary motion of the latch. For this reason, the yarns to be plated cannot be delivered optimally in the case of a compound needle, and hence secure plating is no longer assured.

Because of the intrinsically completely controlled motion of the compound needle, particularly in opening and closing the hook, the compound needle has inherent advantages. However, specific attention must be paid to the above-described disadvantages in the example of plating, when yarns are being caught.

With this as the point of departure, it is the object of the invention to show a way of expanding the possibilities of using compound needles and optionally also latch needles. The expansion of the possibilities for use can be oriented to increasing the knitting speed, stabilizing the knitting operation, broadening the spectrum of use, reducing knitting flaws, lessening the dependency of proper knitting operation on external parameters, and the like.

SUMMARY OF THE INVENTION

This object is attained with the loop-forming system described below and in particular with the use of a novel sinker.

The loop-forming system of the invention includes at least one but preferably many compound needles, or also latch needles, which are movable both in the longitudinal direction of the needle and in one additional direction. The hook of such a compound needle that is movable in two directions may, unlike in a previous kind of loop-forming system, be moved to reciprocate along not only a linear path but many other kinds of paths as well. For instance, in the simplest case, it can be moved back and forth along a curved or intermittently curvilinear path. It is furthermore possible for the hook to be guided along a looplike path, that is, a path that surrounds a two-dimensional area. Hence the hook can execute proper yarn catching motions, which can lead to increasing the knitting speed, improving the plating security in the case of two-yarn goods, reducing the required hook size, and other advantages.

In the use of the second motion component according to the invention in latch needles as well, advantages can be attained, for instance in terms of the security of catching and the association (maintenance of the same order) of yarns.

In the simplest case, the compound needle of the novel loop-forming system has two motion components, namely a linear motion in a first direction and a motion, attained by a pivoting motion, of at least the hook of the compound needle in a second direction. In simple terms, the compound needle can be both longitudinally displaced and pivoted. In the process, the compound needle may be supported in a needle track of a needle bed of a knitting machine, the pivot axis in the needle bed preferably being defined in a stationary way. For instance, it extends transversely through all the needle tracks. The pivoting motion may be limited to only a few degrees, such as 5° or less. Because of the normally relatively great length in the case of a compound needle, the pivoting stroke can cause motions of the hook that are on the order of magnitude of its own dimensions. It becomes clear from this that even a relatively slight pivoting motion can have considerable influence on the loop-forming operation.

The additional motion of the compound needle in its second direction, as a pivoting or linear motion, is preferably oriented perpendicular to the needle back of the compound needle. The improvement in catching the yarn is obtained for instance when the hook moves to the yarn in the process of catching the yarn. The improvement to the loop-forming system with a compound needle in terms of the more-secure catching of the yarn eliminates many disadvantages previously associated with the compound needle. For instance, depending on the particular use, it becomes possible to increase the operating speed of the compound needle, to create plated goods with greater security, and otherwise also to expand to applications in which it was difficult to catch yarns. The more-secure catching of yarns, combined with the controlled motion of the closing element of the compound needle and thus with the controlled opening and closing of the hook, can now lead to high-speed and hence highly productive loop-forming systems, even under difficult conditions.

The motion of the compound needles in the first direction (longitudinal direction of the needle) is preferably brought about in the conventional way by means of a butt of the compound needle and a cam that is in engagement with the butt. The motion of the compound needle in the second direction, for instance in the form of a pivoting motion, is preferably effected by a sinker on which the compound needle rests, for instance with its needle back. The sinker is then disposed in the needle track of a needle bed. It presents a narrow sliding face to the compound needle on which the compound needle can rest with its needle back. The sliding face thus determines the longitudinal orientation of the compound needle. Shifting or pivoting of the sinker in the needle track thus also causes shifting or pivoting of the compound needle.

The sinker is preferably pivotably supported and provided with or connected to a pivot bearing. The pivoting positioning of the sinker can be effected by control means on the sinker, such as a control butt, and in conjunction with control means on the knitting machine, such as a cam. It is also possible to perform the positioning of the sinker by separate closing elements, which in turn are controlled by a control means of the knitting machine. The pivoting motion of the compound needle preferably amounts to only a few degrees. The butts of the compound needle and of its closing element also execute a slight pivoting motion. As a rule, this motion can be absorbed by the play within the needle cam. If needed, these butts may be embodied as somewhat spherical. It is furthermore possible to provide each of the corresponding curved faces of the cam with a slant that corresponds to the pivoted position of the needle. This is possible because an unambiguous, fixed relationship exists between the extended position and the slanted position of the compound needle.

Both the sinker and the compound needle may be assigned a prestressing device, which is formed for instance by suitable springs. They can prestress the compound needle and/or the sinker in a preselected direction, to make it easier to position the compound needle and the sinker.

Further details of advantageous embodiments of the invention will become apparent from the drawings, the description, or the claims.

Exemplary embodiments of the invention are shown in the drawings.

DETAILED DESCRIPTION OF THE INVENTION

Figure 1:
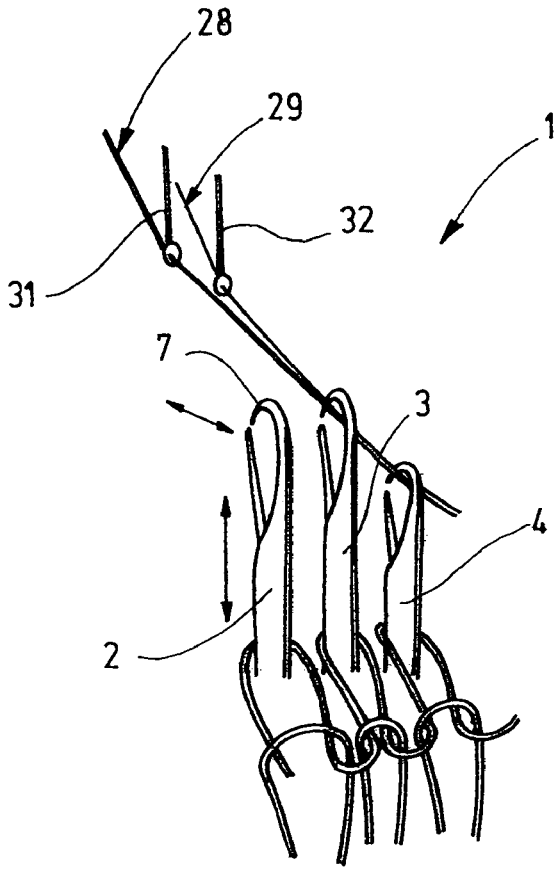
FIG. 1 schematically shows a plurality of compound needles of a loop-forming system in the knitting operation, with two supplied yarns and a knitted product suspended from the compound needles.

In FIG. 1, a loop-forming system 1 is shown in fragmentary, schematic form; it is used to produce knitted goods and can thus also be called a knitting system. The loop-forming system has a plurality of compound needles 2, 3, 4, as well as further compound needles, not shown, embodied substantially identically. The compound needle 2, like all the other compound needles, has a needle body 5 (see FIG. 3) with a shank 6 embodied on it that ends in a hook 7. The compound needle 2 also has a closing element 8, which serves as a closing member for a hook interior 9, surrounded by the hook 7, as can be seen best from FIG. 2. The closing element 8 is movable relative to the shank 6 in the longitudinal direction defined by the shank 6. To that end, it may be supported in or on the shank 6. For instance, the shank 6 may be provided with a closing element slot.

The closing element 8 is provided with or joined to a butt 11 of the closing element, which butt is in engagement with the cam, not further shown, of a knitting machine. The needle body 5 is also provided with a needle butt 12, which is likewise in engagement with the cam of the knitting machine. As a result of the motion of the butt 11 of the closing element and the needle butt 12, the compound needle 2 can be moved in the first direction L, which is marked in FIG. 2 by an arrow and which matches the longitudinal direction of the needle.

The loop-forming system 1 furthermore includes a sinker 14, which is disposed jointly with the compound needle 2 in a needle track 15 of a needle bed 16. The needle track 15 has two flanks, not further shown, that are parallel to one another and forms a narrow groove. The compound needle 2 and the sinker 14 are held between the two flanks. The sinker 14 is disposed between the needle back 17 and the bottom 18 of the needle track 15. It has a narrow sliding face 19, oriented toward the needle back 17, that is embodied in striplike form and is straight at the top, especially in the longitudinal direction of the needle, and the needle back 17 rests on it. The sliding face 19 thus forms a positioning and bearing face for the compound needle 2. It may be embodied cohesively or with one or more interruptions.

Figure 2:
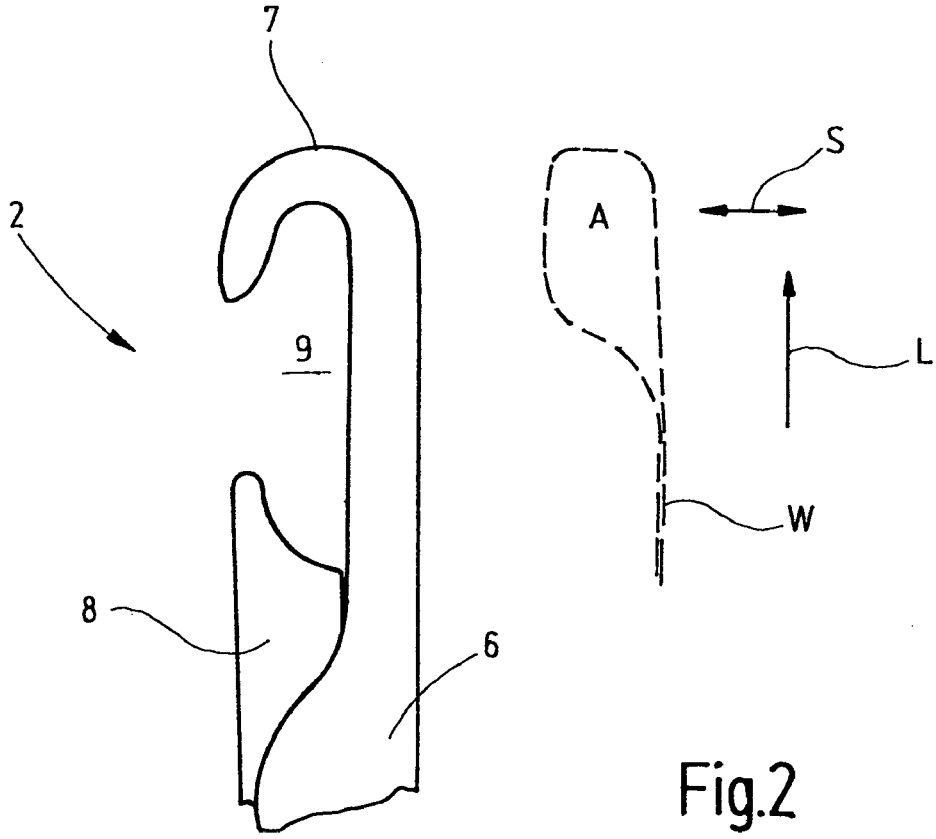
FIG. 2, in a schematic, fragmentary side view, shows a compound needle of the loop-forming system of FIG. 1, with its curving motion represented symbolically.
Figure 3:
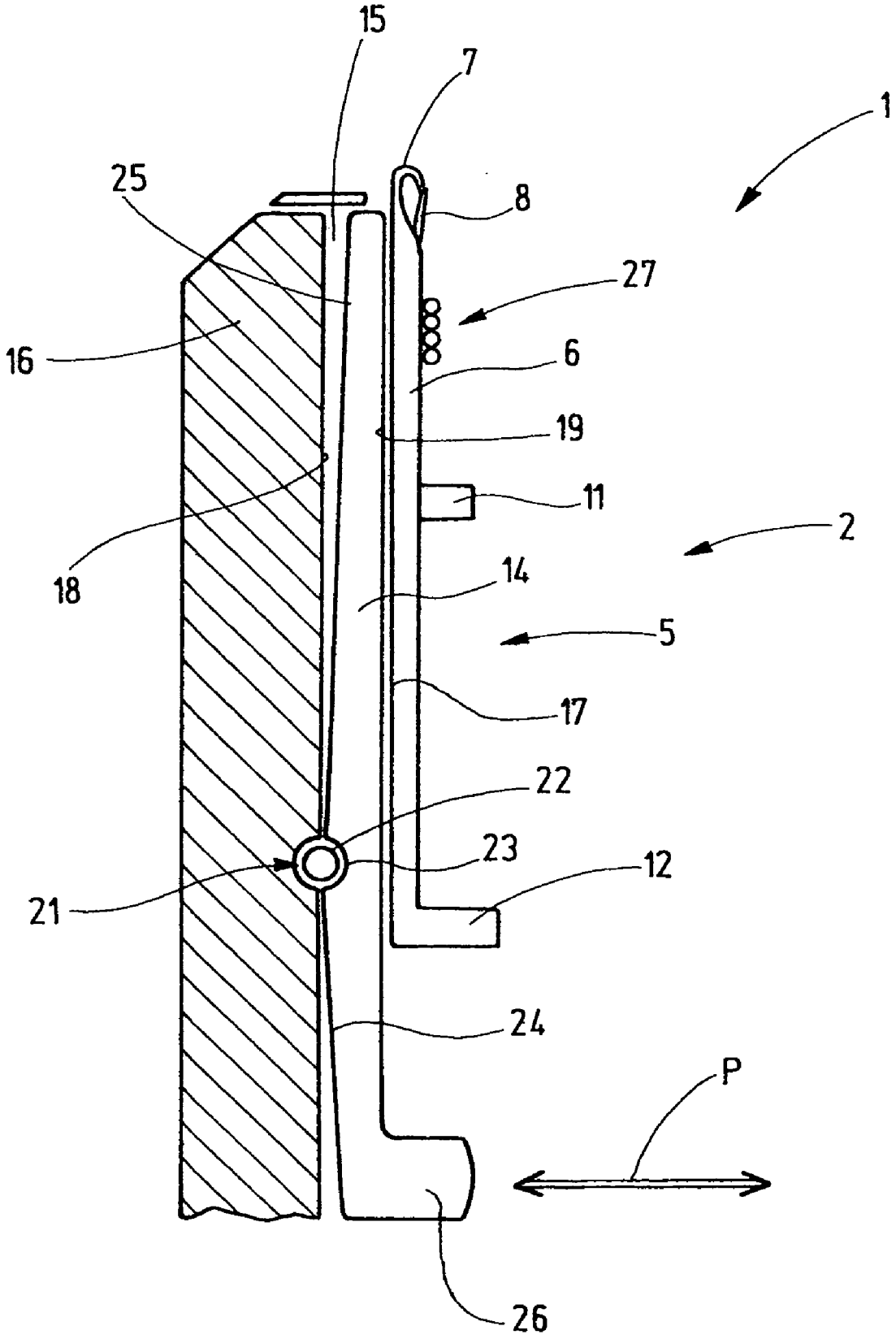
FIG. 3 is a schematic, fragmentary vertical section through a loop-forming system.

The sinker 14 forms a rocker that is pivotably supported in the needle track 15. This purpose is served by a pivot bearing 21, which may for instance be formed by a spring 22 extending transversely through the needle track 15. The spring 22 may for instance be embodied as a resilient ring, a resilient tube, or a helical spring. It may be placed individually into each needle track 15, or it may be seated in a bore or groove with a rounded bottom that extends through all the needle tracks 15. The sinker 14 has a recess 23 with curved edges, and with this recess it sits on the spring 2 with little play. Narrow sides 24, 25 of the sinker 14 extend away from the recess 23 and form an obtuse angle differing only slightly from 180°. Otherwise, the sinker 14 is embodied as a flat sheet-metal part. Preferably on the lower end, located away from the hook 7, in FIG. 3, the sinker 14 is provided with a sinker butt 26, which serves to adjust the pivoting position of the sinker 14. As a result of the pivoting of the sinker 14, the compound needle 2 and especially its hook 7 are also moved in a second direction, here called the pivoting direction S. This direction is marked with an arrow in FIG. 2. It is parallel to the flat sides of the compound needle 2. In FIG. 3, an arrow P for the motion of the sinker butt 26 is correspondingly shown.

The loop-forming system 1 may further include a spring 27, which serves to keep the compound needle 2 in contact with the sinker 14. If the needle bed 16 is embodied as a needle cylinder, the spring 27 is also called a cylinder spring. It may also extend all the way around the entire cylinder and engage all the needles, or it may be in contact with only one or more of the compound needles.

The loop-forming system 1 described thus far functions as follows:

As shown in FIG. 1, the compound needles 2, 3, 4 are extended and retracted again one after the other, in order to grasp one or more yarns 28, 29, which are held in the tuck position by yarn guides 31, 32. FIG. 1 shows the delivery of two yarns 28, 29; the loop-forming process may correspondingly be done with only a single yarn or with multiple yarns. The compound needles are first extended in the longitudinal direction L, as shown in FIG. 2, and then pivoted somewhat by a corresponding actuation of the sinker 14. In the process, they execute a motion in the pivoting direction S, in which the hook interior 9 is moved toward the yarn 28, 29. In the process, the hook 7 is moved in the plane of the drawing in FIG. 2, that is, in the plane in which it is overall located. As a result of the pivoting motion of the hook interior 9 toward the yarns 28, 29, the yarns are securely introduced into the hook interior 9. The closing element 8 can now close the hook interior by moving with its end toward the tip of the hook 7. The reverse stroke of the compound needle 2 can also begin and may also be accompanied by a reverse pivoting motion. The superposition of the motions of the compound needle 2 in both the longitudinal direction L and pivoting direction S creates a path W for each arbitrary point of the hook 7 as shown in a dashed line in FIG. 2. As can be seen, this path W is embodied in looplike form; that is, it encloses an area A. A special feature of the loop-forming system is thus that the hook 7 is moved along a path that includes at least one loop-shaped portion. Taking the rotary motion of a needle carrier, such as a needle cylinder, into account, the hook describes a three-dimensional tuck region.

Figure 4:
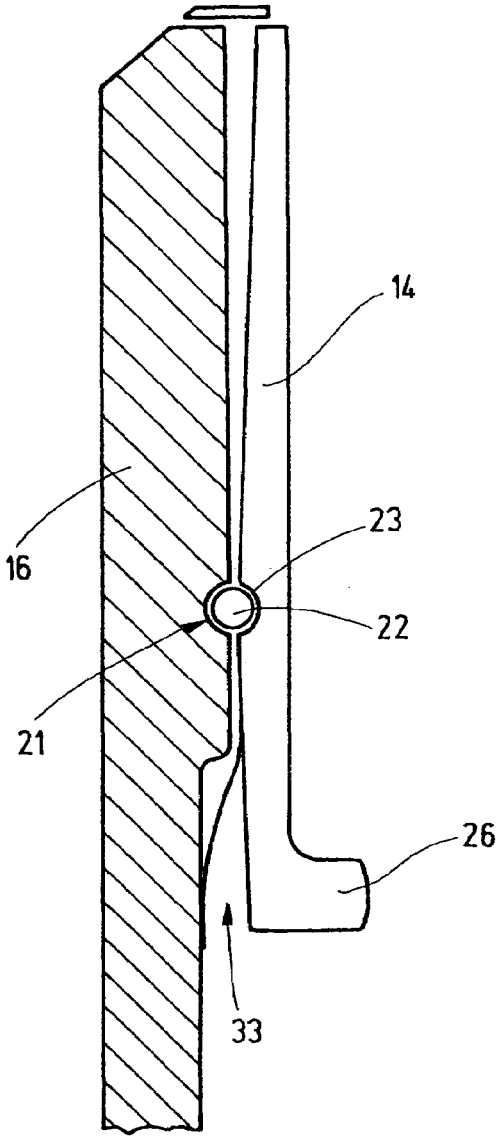
FIG. 4 is a schematic, fragmentary vertical section through a loop-forming system with a resiliently prestressed sinker, with the compound needle not shown.

FIG. 4 illustrates a further feature of the loop-forming system 1 in terms of the needle bed 16 and the sinker 14. Except for the explanations that follow, the descriptions above apply accordingly. A special feature of this embodiment is the resilient bracing of the sinker 14 by a sinker spring 33. It acts between the sinker 14, embodied as above as a rocker, and the needle bed 16. It is disposed in the vicinity of the sinker butt 26 and is embodied as a leaf spring. It may be formed onto the sinker 14 or integrally joined to it. A separate leaf spring may also be secured to the sinker 14 by means of a welded connection. The spring may also be clamped in a slot in the sinker 14. It is also possible for the sinker spring 33 to be embodied as a separate part or joined to the needle bed 16.

Figure 5:
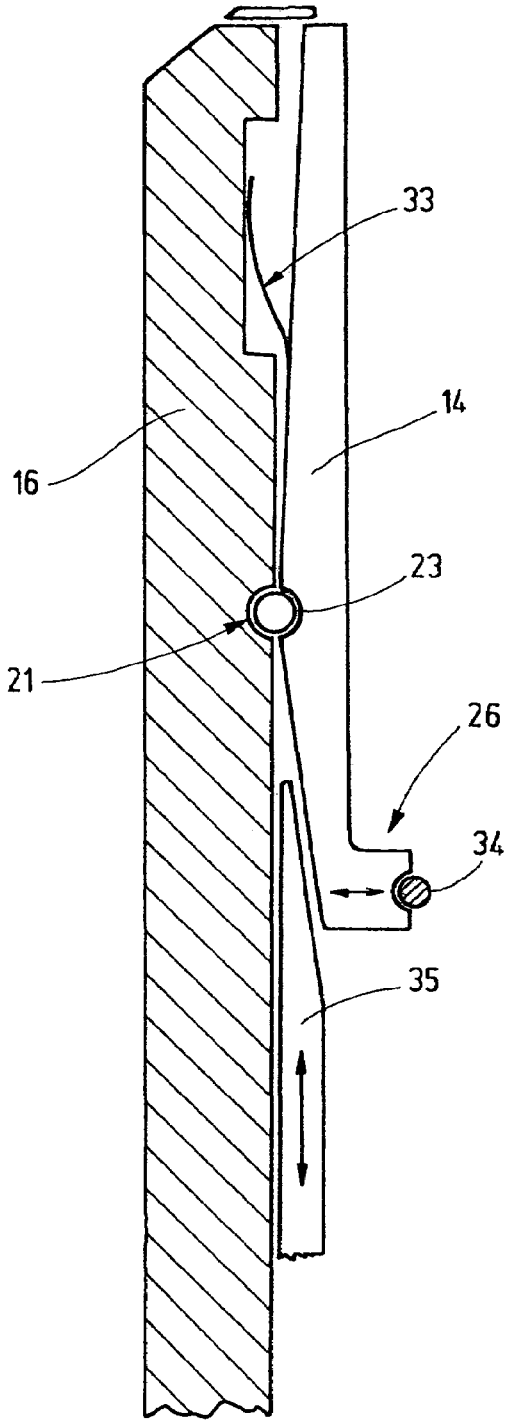
FIG. 5 is a schematic, fragmentary vertical section through a modified embodiment of a loop-forming system, leaving out the compound needle, with a control slide for actuating the pivoting motion of the sinker.

As the embodiment of FIG. 5 shows, the sinker spring 33 may also engage the part of the sinker 14 located above the pivot bearing 21. The sinker butt 33 may in turn be part of the sinker 14 or embodied as a separate part and joined to the sinker 14 or the needle bed 16. In a further modification of the exemplary embodiment, the sinker butt 26 may be prestressed in one direction by an annular spring 34 or some other suitable spring means that spring-loads the special sinker butt 26, or all the sinker butts 26. Thus in the embodiment of FIG. 5, both as a consequence of the action of the sinker spring 33 and as a consequence of the action of the annular spring 34, the sinker has the tendency to pivot clockwise. The actual pivoting position may then be adjusted by means of a tapering compound needle 35, which is in communication with the cam of the knitting machine by means of a butt, not otherwise shown, of the closing element. An axial displacement of the tapering compound needle 35 is thus converted into a pivoting motion of the sinker 14. As a result of this as well, the function explained above in conjunction with FIGS. 1 and 2 can be attained, that is, the pivoting motion of the compound needle 2.

Figure 6:
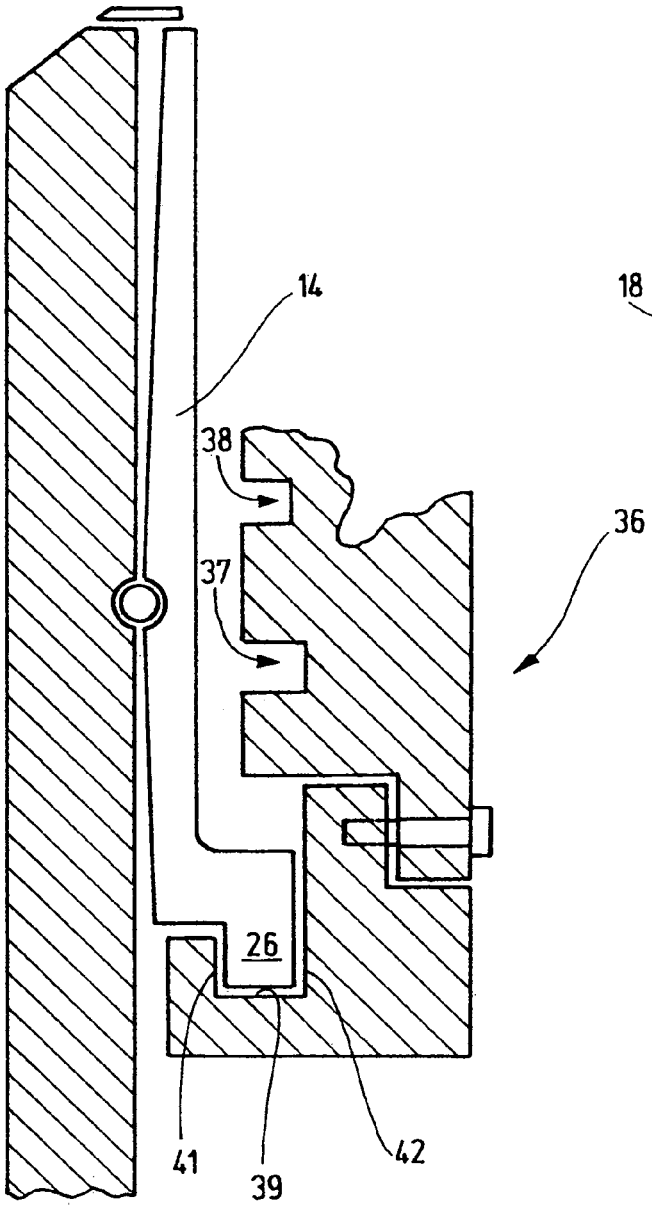
FIG. 6 is a schematic vertical section showing the needle bed, the pivoting sinker, and the cam of a knitting system.

FIG. 6 illustrates the interplay between one embodiment of the sinker 14 and a cam 36, which has a first control track 37 for moving the compound needle 2 in its first direction, a control track 38 for the closing element, and a further control track 39 for moving the sinker 14. The sinker butt 26 here is embodied with a double right-angle bend, so that the control track 39 can completely control the pivoting motion of the sinker 14. To that end, the control track has two diametrically opposed control faces 41, 42, between which the control foot 26 is held with little play and which are oriented in and counter to the pivoting direction S, respectively. The sinker 14 makes do without resilient prestressing. For reinforcement, however, a sinker spring 33 of one of the examples discussed above may also be provided.

Figure 8:
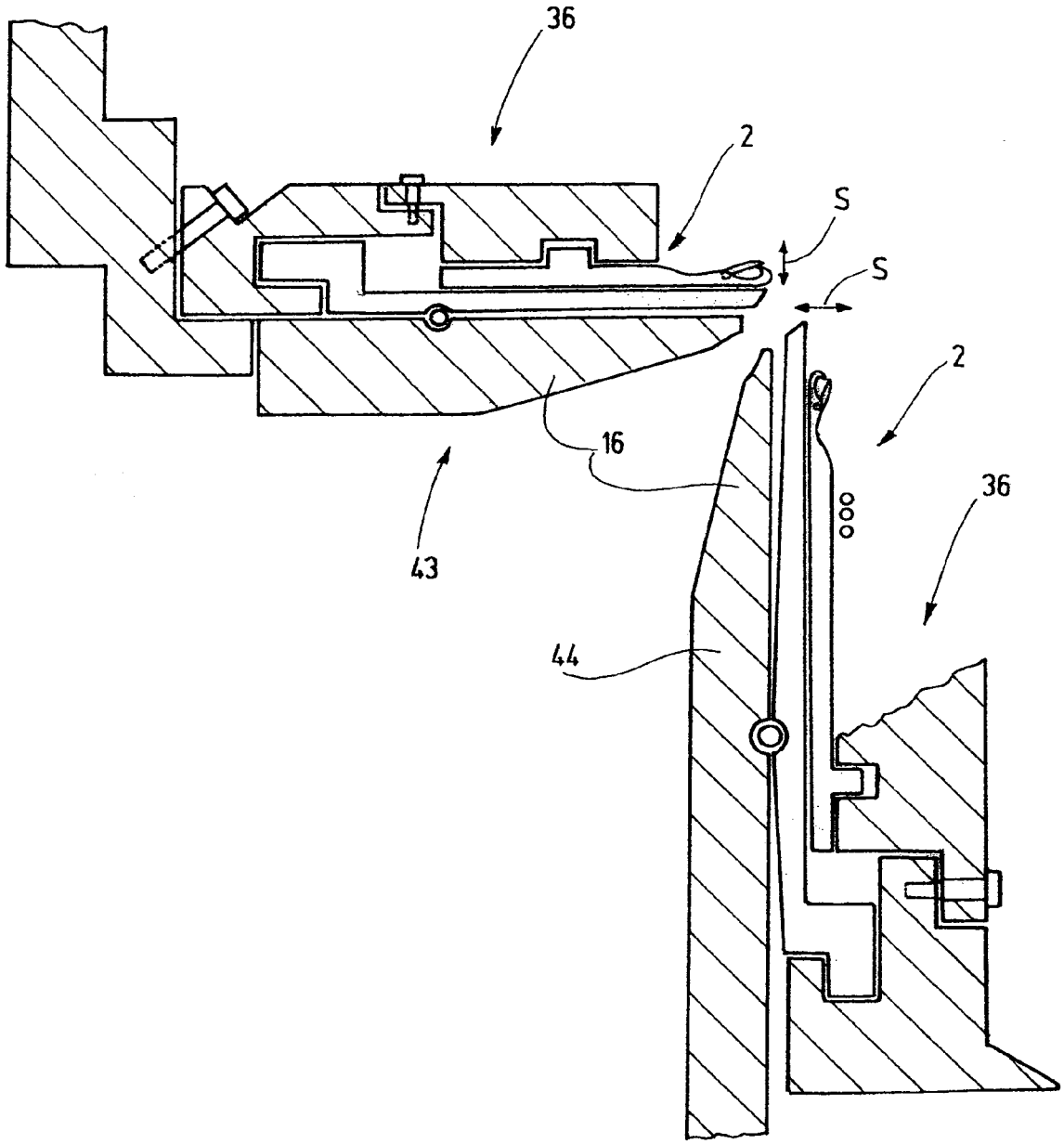
FIG. 8 is a schematic vertical section through a knitting system with a knitting cylinder and a dial and with pivotably supported compound needles.

FIG. 8 shows the loop-forming system 1 employed for a dial as well as for a needle cylinder. Instead of compound needles, latch needles are provided. The needle bed 16 shown at the top in FIG. 8 forms the dial 43, while the needle bed 16 shown on the right forms the needle cylinder 44. The dial 43 and the needle cylinder 44 are part of a circular knitting machine. They each have their own cam 36, which is embodied for instance as in the exemplary embodiment of FIG. 6. The loop-forming operation proceeds essentially as in a conventional circular knitting machine; the extension and retraction motions of the latch needles 2 each have a pivoting motion in the second direction S superimposed on them, so that the compound needles 2 traverse a path W for instance as in FIG. 2.

Figure 7:
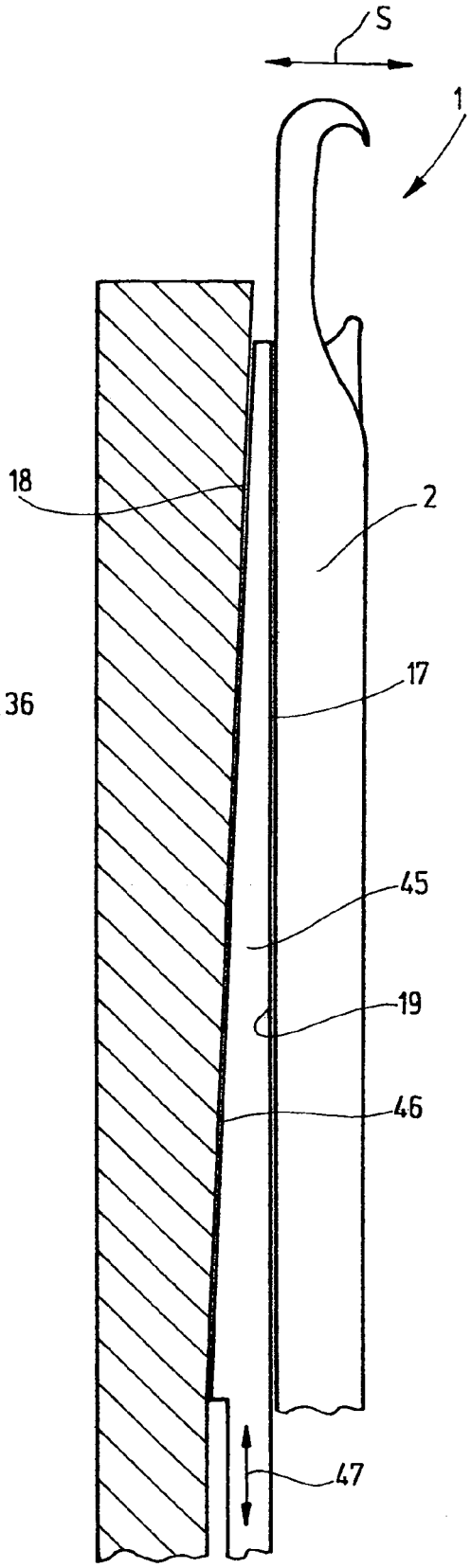
FIG. 7 is a schematic vertical section through a modified embodiment of the knitting system with a wedge-shaped sinker.

FIG. 7 shows a further modification of the loop-forming system 1 described thus far. In this modification, the compound needle 2, for executing its motion in the second direction, is not pivoted but rather is shifted linearly. To that end, a sinker 45 that acts as the wedge may be disposed between the needle back 17 and the bottom 18. The sliding face 19 of this sinker and the side 46 oriented toward the bottom 18 form an acute angle with one another. The bottom 18 is also inclined at a correspondingly acute angle from the longitudinal direction of the compound needle 2. A corresponding motion, controlled by a sinker butt not otherwise shown, in the direction of the arrow 47 in FIG. 7 thus causes shifting of the compound needle 2 in the second direction S, regardless of its longitudinal position. Spring means not otherwise shown may press the compound needle 2 against the sinker 45.

Figure 9:
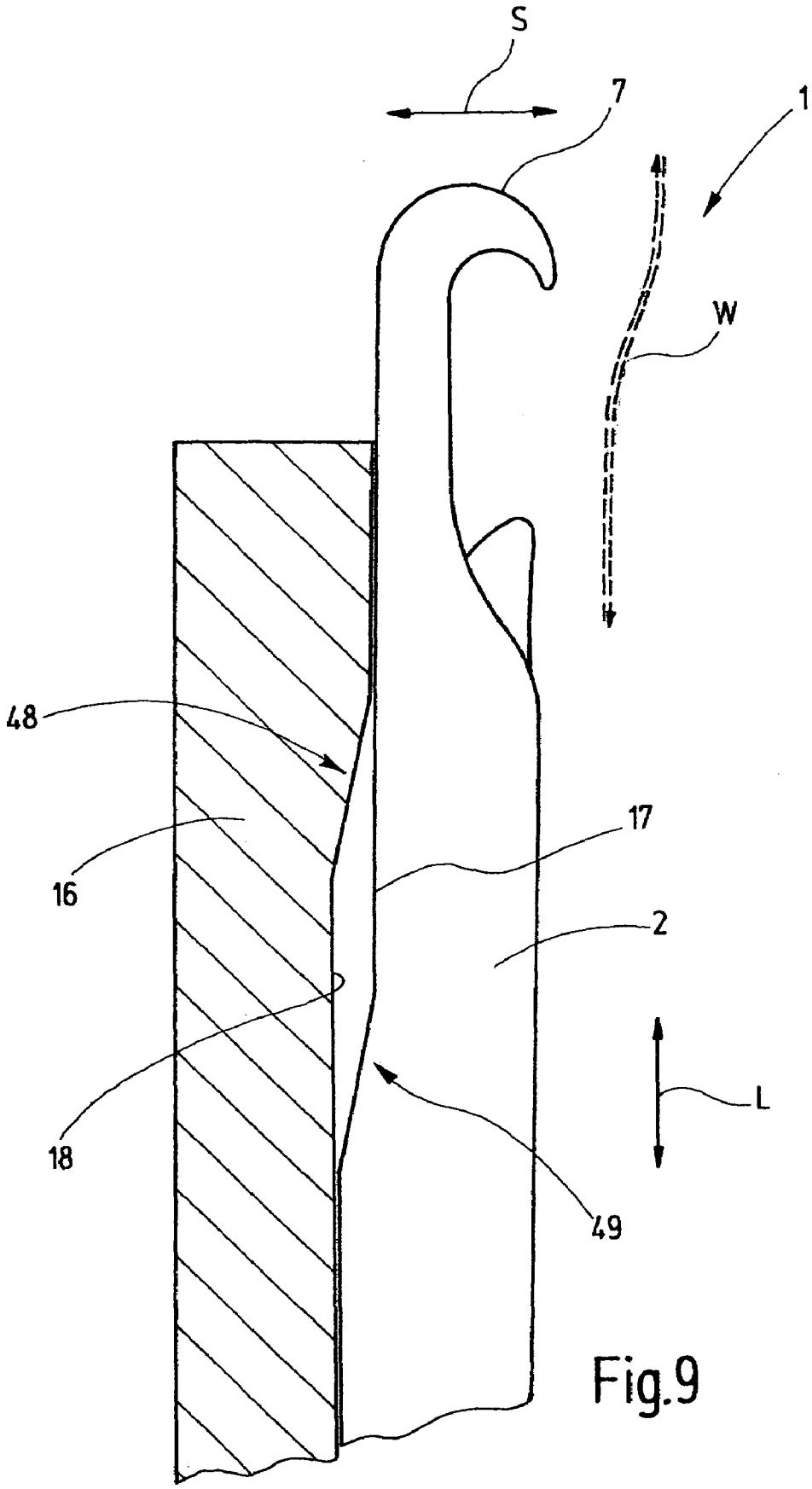
FIG. 9 is a fragmentary, schematic vertical section through a knitting system with a compound needle, without a control sinker, that is movable in two directions and with a guide contour in the needle bed.

Finally, in FIG. 9, a further embodiment of the loop-forming system 1 is shown, which makes do without a sinker and nevertheless makes a motion of the compound needle 2 possible in both its longitudinal direction L and its second direction S. To that end, the bottom 18 of the needle bed 16 is provided with a control profile 48, for instance in the form of a ramp. A profile 49 complementary to it, for instance likewise in the form of a ramp, is embodied on the needle back 17. When the compound needle 2 is now moved linearly, it first executes a linear longitudinal motion in the direction of the longitudinal direction L (first direction). As soon as its profile 49 comes into contact with the control profile 48, however, the profile 49 moves up the ramp formed by the control profile 48, and as a result the compound needle 2 executes an additional motion in the second direction S. This additional motion may be used as a yarn gripping motion. The special feature of this embodiment is its simplicity. The sinker 14 or 45 described above may be omitted, thus also making the cam simpler. However, if that is done, the path W of the hook 7 does not define a two-dimensional area and hence is not in the shape of a loop. For many applications, however, substantially improved yarn catching capability is achieved compared to the purely linear motion of a compound needle.

In an improved loop-forming system 1, in particular for compound needles 2, the compound needle during the knitting operation is moved along a nonlinear path. Depending on the embodiment, this path may be a loop, may include a loop, or maybe embodied without a loop. This is achieved by superimposing a transverse motion on the reciprocating needle motion; the transverse motion may be controlled for instance by a pivotably supported sinker, which is disposed in the needle track and defines the pivoting orientation of the compound needle 2.

It will be appreciated that the above description of the present invention is susceptible to various modifications, changes and adaptations, and the same are intended to be comprehended within the meaning and range of equivalents of the appended claims.

| List of Reference Numerals: | |
|---|---|
| 1 | Loop-forming system |
| 2, 3, 4 | Knitting tool/compound needles |
| 5 | Needle body |
| 6 | Shank |
| 7 | Hook |
| 8 | Closing element |
| 9 | Hook interior |
| 11 | Butt of closing element |
| 12 | Needle butt |
| 14 | Sinker |
| 15 | Needle track |
| 16 | Needle bed |
| 17 | Needle back |
| 18 | Bottom |
| 19 | Sliding face (narrow side) |
| 21 | Pivot bearing |
| 22 | Spring |
| 23 | Recess |
| 24, 25 | Narrow sides |
| 26 | Sinker butt |
| 27 | Spring |
| 28, 29 | Yarns |
| 31, 32 | Yarn guides |
| 33 | Sinker spring (prestressing device) |
| 34 | Annular spring |
| 35 | Tapering compound needle |
| 36 | Cam |
| 37, 38, 39 | Control track |
| 41, 42 | Control faces |
| 43 | Dial |
| 44 | Needle cylinder |
| 45 | Sinker |
| 46 | Side |
| 47 | Arrow |
| 48 | control profile |
| 49 | Profile |
| A | Area |
| L | Longitudinal direction/first direction |

-continued

| List of Reference Numerals: | |
|---|---|
| S | Pivoting direction/second direction |
| W | Path |

What is claimed is:

1. A loop-forming system having at least one knitting tool, which has a shank with a hook on one end and has a closing member which is movable in order to open and close the hook, wherein the knitting tool in the loop-forming system is movable both in a first direction (L) matching the longitudinal direction of the knitting tool and a second direction (S) which is oriented transversely to the first direction (L), with the knitting tool performing a yarn catching movement on a path from the first direction having a component in the second direction (S) while in an extended position.

2. The loop-forming system according to claim 1, wherein the knitting tool is a compound needle, whose closing member is embodied as a closing element that is movable in the longitudinal direction (L) of the shank.

3. The loop-forming system according to claim 1, wherein the knitting tool is a latch needle, whose closing member is embodied as a latch that is supported pivotably about an axis oriented transversely to the longitudinal direction (L) of the shank.

4. The loop-forming system according to claim 2, wherein the compound needle is supported pivotably, in order to enable to motion in the second direction (S).

5. The loop-forming system according to claim 1, wherein the second direction (S) matches a hook opening direction.

6. The loop-forming system according to claim 2, wherein the loop-forming system includes a needle bed, which for each compound needle has one needle track, embodied as a narrow groove, between whose parallel flanks the compound needle is guided displaceably, and both the motion of the compound needle in the first direction (L) and the motion of the compound needle in the second direction (S) are defined parallel to the flanks.

7. A loop-forming system comprising:

at least one compound needle, which has a shank with a hook on one end and has a closing element that is movable in the longitudinal direction (L) of the shank in order to open and close the hook;

a needle bed, which for each compound needle has one needle track, embodied as a narrow groove between whose parallel flanks the compound needle is guided displaceably with the compound needle being moveable in the loop-forming system both in a first direction (L) matching the longitudinal direction of the compound needle and a second direction (S) that is oriented transversely to the first direction (L) and with both the motion of the compound needle in the first direction (L) and the motion of the compound needle in the second direction (S) being defined parallel to the flanks of the needle track; and, a sinker is disposed movably in the needle track and has having a narrow side, on which a needle back embodied on the compound needle rests in order to move the compound needle in the second direction (S).

8. The loop-forming system according to claim 2, characterized in that the loop-forming system includes a needle bed, which for each compound needle has one needle track, embodied as a narrow groove with parallel flanks and a bottom, which is provided with a control profile for moving the compound needle in the second direction (S).

9. A sinker for a loop-forming system having at least one knitting tool, which has a shank with a hook on one end and has a closing member that is movable in order to open and close the hook, with the compound needle being moveable in the loop-forming system both in a first direction (L) matching the longitudinal direction of the knitting tool and a second direction (S) which is oriented transversely to the first direction (L) in response to movement of a sinker; and wherein the sinker has a narrow sliding face for supporting the longitudinally movable compound needle knitting tool; and the loop-forming system has an adjusting device for the controlled motion of the sliding face of the sinker.

10. The sinker according to claim 9, wherein the sinker is arranged for connection to a pivot bearing of a loop-forming system.

11. The sinker according to claim 9, wherein the sinker has at least one sinker butt.

12. The sinker according to claim 9, wherein a prestressing device is assigned to the sinker.

* * * * *